US005507241A

United States Patent [19]

Evans

[11] Patent Number: 5,507,241

[45] Date of Patent: Apr. 16, 1996

[54] CAP DRIVER FOR EMBROIDERY MACHINE

[76] Inventor: Kenneth H. W. Evans, Rt. 6, Box 276 AA, McKinney, Tex. 75069

[21] Appl. No.: 437,455

[22] Filed: May 8, 1995

[51] Int. Cl.[6] ..... D05B 21/00

[52] U.S. Cl. ..... 112/470.18

[58] Field of Search ..... 112/470.06, 103, 112/470.09, 470.14, 470.18, 475.05, 63, 102, 104

[56] References Cited

U.S. PATENT DOCUMENTS

| | | | |
|---|---|---|---|
| 4,555,999 | 12/1985 | Conner | 112/104 |
| 4,628,843 | 12/1986 | Tajima | 112/309 |
| 4,653,415 | 3/1987 | Tajima | 112/308 |
| 4,665,844 | 5/1987 | Shibata | 112/103 |
| 4,998,964 | 3/1991 | Golia | 112/103 |
| 5,261,338 | 11/1993 | Tajima et al. | 112/103 |
| 5,271,347 | 12/1993 | Fontcuberta | 112/63 X |
| 5,277,140 | 1/1994 | Nakagaki | 112/470.06 X |

*Primary Examiner*—Ismael Izaguirre
*Attorney, Agent, or Firm*—Robert A. McFall

[57] ABSTRACT

A cap driver for supporting a cap holder on an embroidery machine has a cylindrical shell that is yieldably biasedly supported on support rollers and guided during rotation by guide wheels that are rotatably attached to one end of a pivotable arm that allows the guide wheels, and cylindrical shell, to ride over obstructions that may occur during rotation of the shell. The guide wheels mate with a rail that has a surface elevated above the outer surface of the shell. The cap driver overcomes the problem of fixed support and guide wheels that previously caused distortion of the cylindrical shell when obstructions were encountered during rotation. Also, the present invention overcomes the problem of debris buildup in a circumferential guide groove on the outer surface of the shell.

8 Claims, 4 Drawing Sheets

CAP DRIVER FOR EMBROIDERY MACHINE

TECHNICAL FIELD

This invention relates generally to embroidery machines, and more particularly to a driver for a cap holder on an embroidery machine.

BACKGROUND ART

Automatic, computer controlled, embroidery machines for forming decorative needlework designs have been used for a number of years, particularly for placing embroidered logos, symbols and messages on baseball caps. A machine specifically adapted for embroidering designs on caps is described in U.S. Pat. No. 4,628,843, issued Dec. 16, 1986 to Ikuo Tajima. The Tajima machine has a table, moveable along a Y-axis, that carries a plurality of drivers each of which detachably support a holder for a single cap. One machine may have up to 18 of the drivers, each of which are rotatable about an axis parallel to the Y-axis to affect rotation of the holder and mounted cap in a direction transverse to the Y-axis, i.e., along an X-axis on the cap. A reciprocable needle is positioned at the intersection of the X and Y axes and embroiders the design on the cap as the cap is controllably moved in the X and Y directions. The needle places each stitch at a preselected position on the cap, determined by translation of the moveable table along the Y-axis, and individual rotation of each of the drivers supporting the cap holder to bring the cap embroidery area into the desired X-axis position. Such machines have been commercially successful and have enabled a wide range of designs and expressions to be attractively placed on a useful article of clothing.

However, it has been found that after such machines have been in operation for as short of a time as a few months depending on care and usage, that the quality of the embroidered design deteriorates. The image tends to become less distinct, sharp-lined features become somewhat jagged, and there is a noticeable overlap of adjacently disposed colored areas. It was believed that the problem resulted from a loss of tight engagement of the cap holder with its respective driver. In an effort to maintain a perceived better fixed relationship between the cap holder and its driver, a different mounting arrangement was proposed as described in U.S. Pat. No. 5,261,338, issue Nov. 16, 1993 to Ikuo Tajima et al.

However, it has been discovered that the interconnection between the cap holder and its driver is not the primary cause of quality deterioration in the embroidered design. The Tajima embroidery machine supports the cap driver on a pair of fixed rollers that contact an internal arcuate surface of the driver, and guide the driver by a pair of fixed rollers that ride in a groove formed in an external arcuate surface of the driver. During the embroidery operation, the grooves become contaminated with pieces of thread, dust, dirt and other debris. With each pass of a roller in the groove, the material in the groove is compacted on top of previously compacted debris. Since the rollers are fixed and cannot yield, the driver surfaces become distorted with the result that the driver no longer rotates smoothly or uniformly about the Y-axis to position the embroidery area of the cap in the proper X-axis registration. This causes jerking and displacement of the cap holder mounted on the driver, with the result that the needle stitch does not occur at its desired position. Also, because the rollers are made of a harder material than the mating groove, the sides of the groove wear. The additional groove width makes it difficult, if not impossible, to accurately control the Y-axis position of the driver assembly. Thus, it can be readily seen that when the above described wear or damage occurs, the operating position of the driver will be directly and adversely affected, resulting in decreased quality of the embroidered design.

Also, the rotation, and consequently the X-axis orientation of the embroidery area of each of the cap drivers is controlled by a connecting link between each driver and an actuating arm. Any resistance to movement or uneven motion by any one driver may be translated through the connecting link and actuating arm to other drivers, causing inaccurate positioning of other cap holders. Thus, each irregular movement, although primarily caused by a single driver, is easily multiplied.

Furthermore, it has been noted that when several drivers become difficult to move because of guide groove buildup and bending or distortion of the arcuate roller reaction surfaces on the drivers, the X-axis positioning motor becomes heated to a significantly higher temperature than normal. Also, the actuating linkage between the motor and the cap drivers show visible evidence of stress and excessive wear. Both of these conditions are a further indication that one or more of the cap drivers is binding and is not freely rotatable to the desired orientation.

The present invention overcomes the problems set forth above. It is desirable to have a cap driver that even after extended periods of operation is able to accurately and repeatedly produce a quality embroidered decorative design on a cap. It is also desirable to have a cap driver that is not prone to the collection and buildup of debris in a critical guide or support element. It is also desirable to have a cap driver that is not bent or damaged as a result of debris buildup between fixed position rollers and reaction surfaces on the cap driver.

SUMMARY OF THE INVENTION

In accordance with one aspect of the present invention, a cap driver for an embroidery machine includes a cylindrical shell having arcuate inner and outer surfaces that is supported by a plurality of rollers that are rotatably mounted on a moveable frame portion of the machine and are in rolling contact with the arcuate inner surface of the cylindrical shell. The cap driver also includes a circular rail member that is circumferentially mounted on the arcuate outer surface of the cylindrical shell and has a predefined outer surface disposed in radially spaced relationship outwardly from the arcuate outer surface of the cap driver. A plurality of guide wheels are rotatably mounted on the moveable frame of the embroidery machine and are pivotably moveable about a predetermined position on the frame. Each of the guide wheels have a circumferentially disposed flanged portion shaped to engage at least a portion of the predefined outer surface the circular rail member. The flanged portion of each of the guide wheels is maintained in pliant biased contact with the outer surface of the rail member.

Other features of the cap driver embodying the present invention include the circular rail member having an inverted V cross-sectional shape, and the circumferentially disposed flanged portion of each of the guide rollers is defined by a mating V-shaped groove.

BEST MODE FOR CARRYING OUT THE INVENTION

Figure 1:
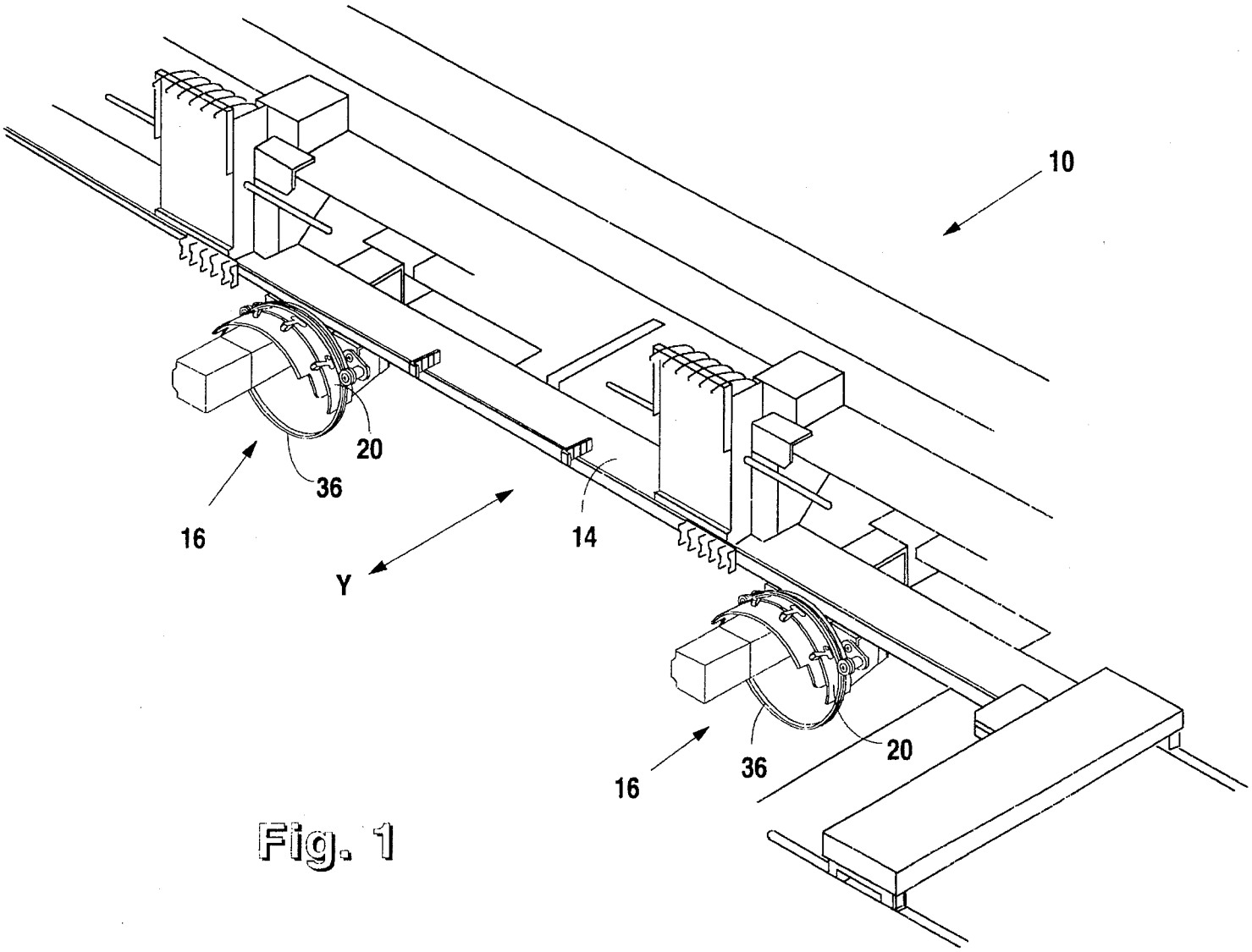
FIG. 1 is a perspective view of a portion of an embroidery machine having a plurality of cap drivers embodying the present invention mounted thereon.
Figure 2:
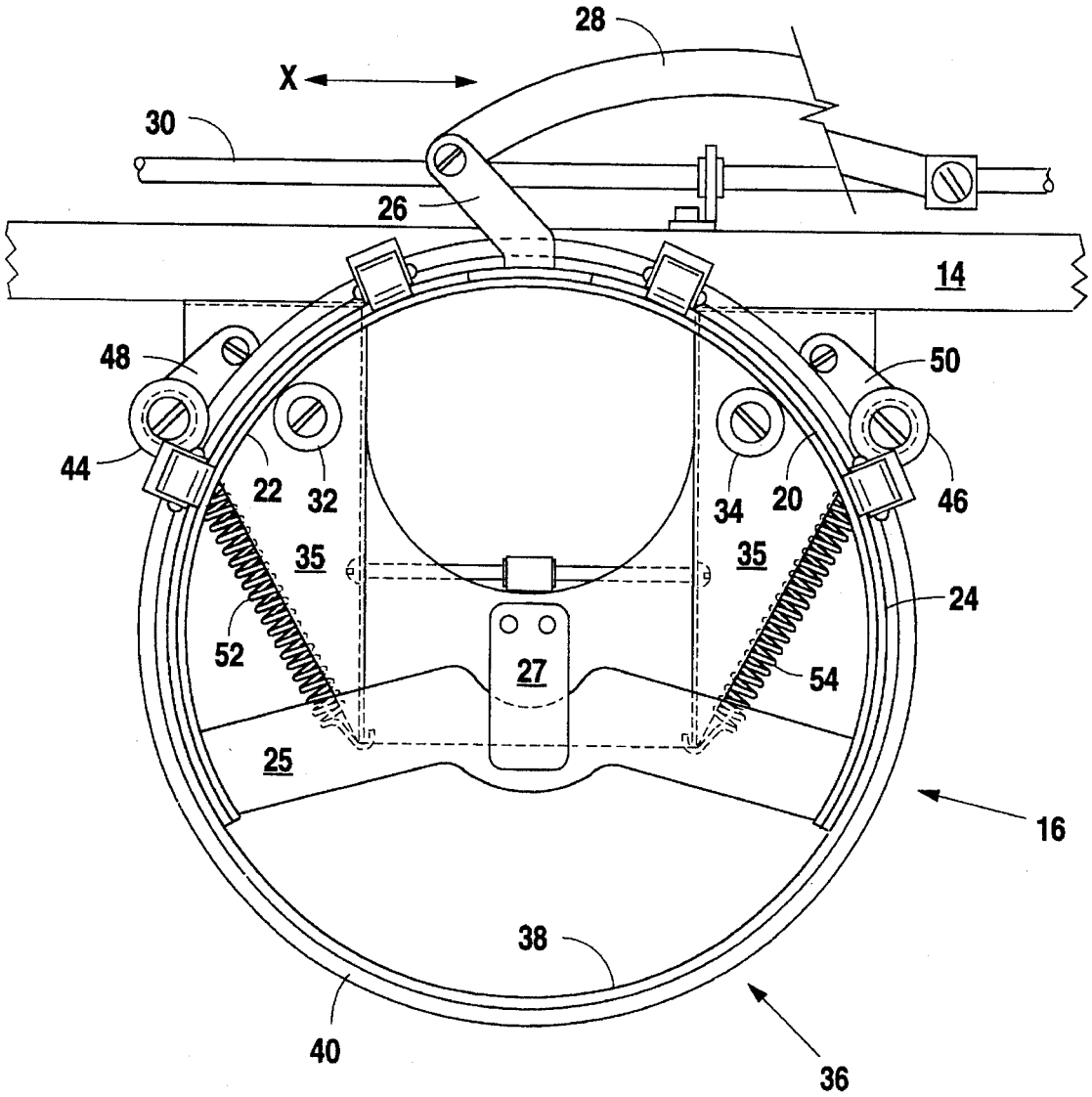
FIG. 2 is a front view of a cap driver embodying the present invention.
Figure 3:
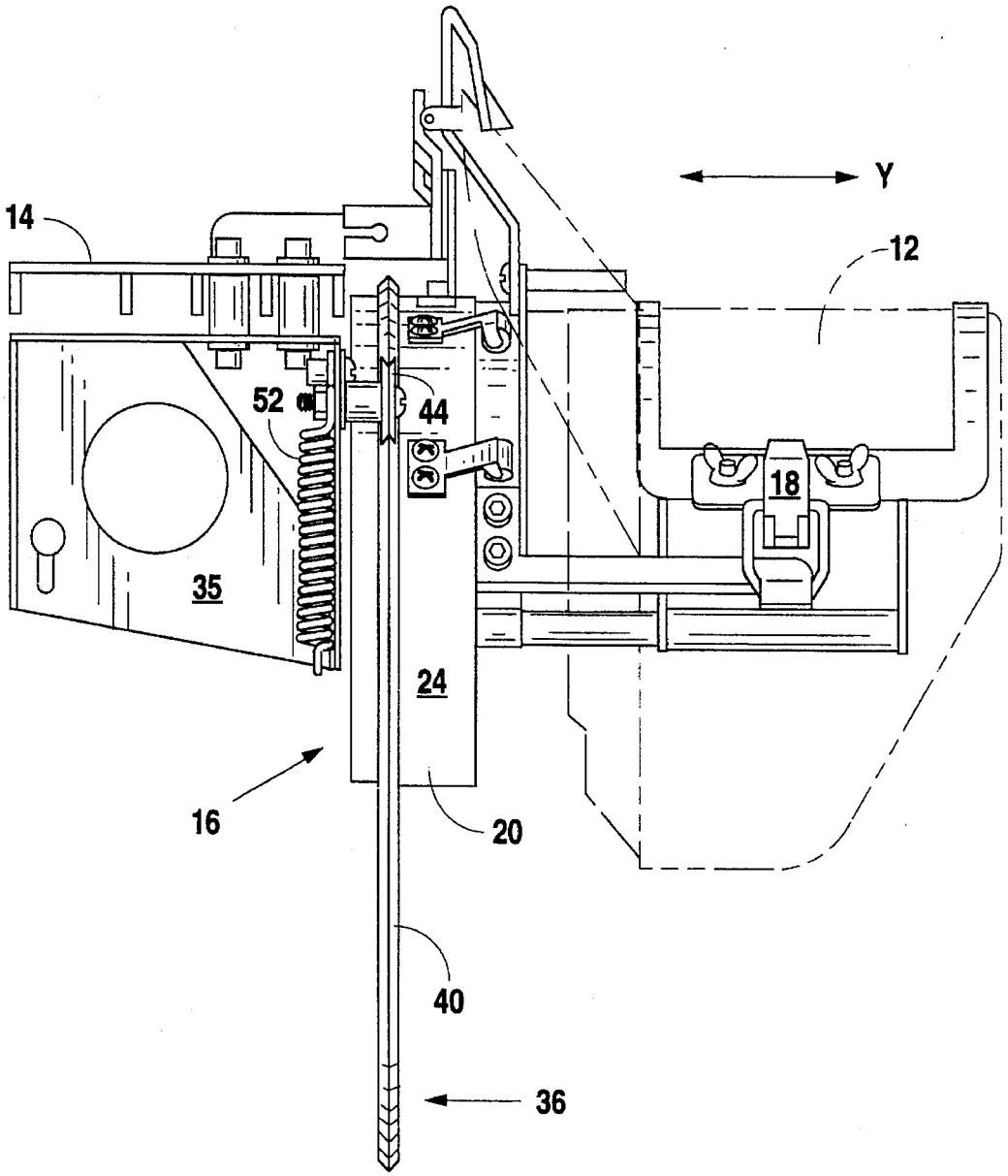
FIG. 3 is a side view of a cap driver embodying the present invention.
Figure 4:
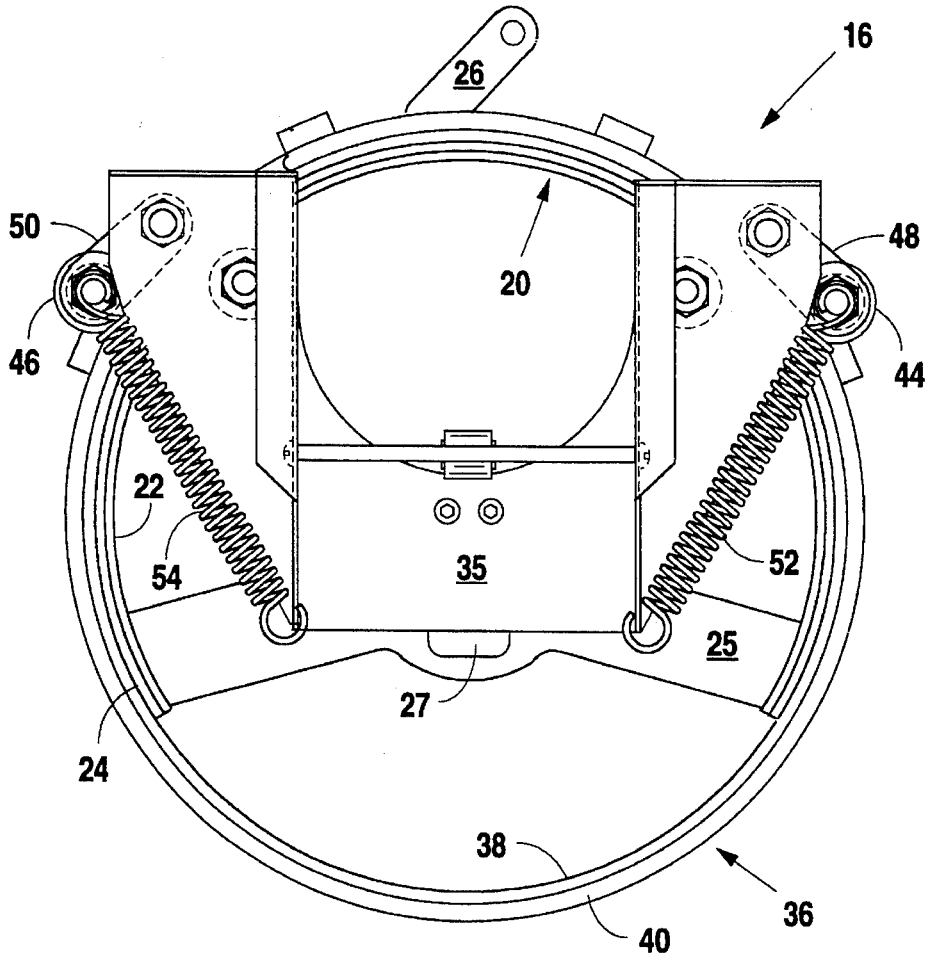
FIG. 4 is a rear view of a cap driver embodying the present invention.

A portion of an embroidery machine 10 suitable for carrying out the present invention is shown in FIG. 1, and described in detail in the aforementioned U.S. Pat. No. 4,628,843. Embroidery machines of this type are specifically constructed to embroider a decorative design, such as a logo or message, on the front of a cap 12. The embroidery machines have a frame 14 that is moveable along a Y-axis, as shown in FIG. 1, and on which are mounted a plurality, e.g. up to 18, of separate cap drivers 16. As best shown in FIG. 3, each of the cap drivers 16 support a detachable cap holder 18 on which the cap 12 is clamped. Each of the cap drivers 16 are rotatable about the Y-axis to controllably position a desired point in the embroidery area of the cap 12 tangent to an X-axis, as indicated in FIG. 2. An embroidery needle, not shown, reciprocates along an axis that intersects the intersection point of the X and Y axes.

Each of the cap drivers 16 has a cylindrical shell 20 that has an arcuate inner surface 22 and an arcuate outer surface 24. The cylindrical shell 20 is an open-ended circular cylinder, and desirably also has one side open so that the shell 20 has a C-shape that extends more than 180° but less than 270° around a true circle. In the preferred embodiment of the present invention, the wall of the cylindrical shell 20 extends around a 210° segment of a circle. A web member 25 extends between the ends of shell 20 and is slidably received within a slot formed in a teflon, or similar low friction material, guide 27, mounted on a support bracket 35. Each of the shells 20 also have means, as fully described in the aforementioned U.S. Patents, to detachably support a single cap holder 18.

Each cylindrical shell 20 has a radially extending arm 26 that is pivotally connected, by way of a connecting link 28 that is adjustably attached to an actuator rod 30. Movement of the actuator rod 30 along the X-axis will rotate the cylindrical shell 20 and, accordingly, position the embroidery area of a cap 12 at a desired x-axis orientation. Each of the cylindrical shells 20 are similarly attached to the actuator rod 30, and thus it can be seen that movement of the actuator rod 30 will simultaneously position each shell 20 in the same respective orientation with respect to the X-axis.

Each of the cylindrical shells 20 are supported on a pair of rollers 32,34 that are rotatably mounted at a fixed position on the bracket 35 which is affixed to the moveable frame 14 and operatively functions as an extension of the frame itself. The arcuate inner surface 22 of the cylindrical shell 20 is in direct contact with the rollers 32,34 so that when the shell 20 is rotated, as a result of aforementioned described movement of the actuator rod 30, the rollers also rotate to provide rolling contact support of the cylindrical shell 20.

Figure 5:
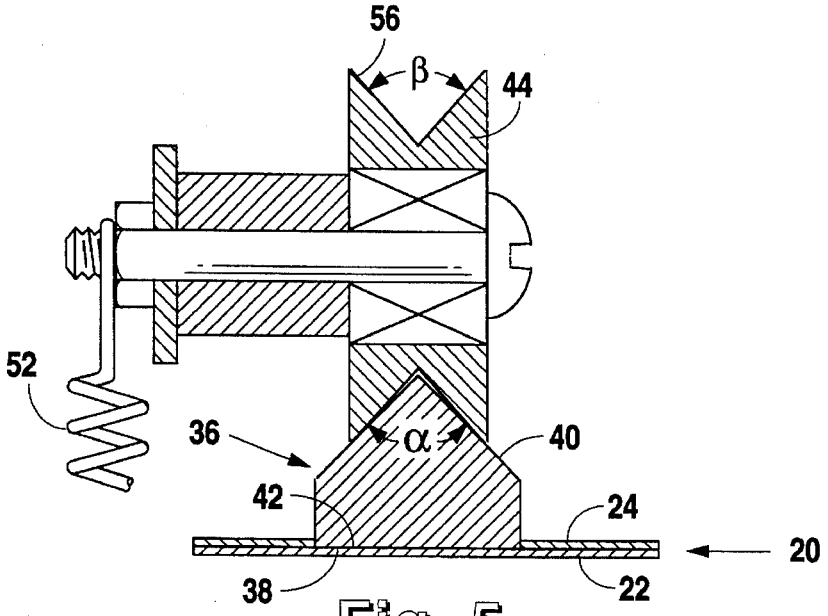
FIG. 5 is a sectional view through a guide roller and ring member of the cap driver embodying the present invention.

Importantly, the cap driver 16 embodying the present invention has a circular rail member 36 that is circumferentially mounted on the arcuate outer surface 24 of the cylindrical shell 20. The circular rail member 36 has a radially inwardly disposed, or bottom, surface 38 and an outer, or upper, surface 40. Desirably, the arcuate outer surface 24 of the cylindrical shell 20 has a circumferential groove 42 that extends around the shell 20 and has a width equal to the width of the circular rail member 36. In this arrangement, the circular rail member 36 can be deformed from its circular shape sufficiently to allow it to be slipped over the arcuate outer surface 24 and positioned in the groove 42. As best shown in FIG. 5, the bottom surface 38 of the circular rail member is in forced abutment with the groove 42.

The outer surface 40 of the circular rail member 36 has a predefined shape, or contour that, after assembly of the rail member 36 on the shell 20, is elevated above, i.e., radially outwardly spaced from, the outer surface 24 of the shell 20. In the preferred embodiment of the present invention, the outer surface 40 has, when viewed in cross section, the shape of an inverted V, with an included angle between the divergent legs of the V of 90°.

The cap driver 16 embodying the present invention also has a pair of guide wheels 44,46 that are rotatably mounted on a first end of respective moveable arms 48,50. The second end of each of the moveable arms 48,50 is pivotably mounted on the bracket 35 affixed to the moveable frame 14. One of a pair of tension springs 52,54 is respectively connected between the first end of each of the moveable arms 48,50 and a lower part of the bracket 35 to urge the guide wheels 44,46 radially inwardly toward the circular rail member 36.

Each of the guide wheels 44,46 has a circumferentially disposed flanged portion that is shaped to mate with the contour of the outer surface of the circular rail member 36. In the preferred embodiment of the present invention, the circumferentially disposed flanged portion of each of the guide wheels 44,46 is defined by a V-shaped groove 56. The included angle $\beta$ between the converging legs of the V groove on the guide wheels 44,46 should be no larger than the included angle $\alpha$ on the outer surface 40 of the circular rail member 36. Desirably, the included angle $\beta$ is slightly less than the angle $\alpha$, e.g. 89° allowing some wear on the inner side surfaces of the groove on the guide wheels 44,46 before "bottoming out" on the tip and base of the respective V-shaped elements. Also, the smaller included angle $\beta$ of the grooves enables the outer circumferential edges of the guide wheels 44,46 to be self-sharpening as the wheel wears against the rail member 36. It has been observed that the sharp edges readily cut threads or string material that may fall on the rail member 36 during operation of the embroidery machine, with the severed portions freely falling away from the rail member 36.

Preferably the circular rail member 36 and the guide wheels 44,46 are constructed of steel. Also, the outer surface 40 of the circular rail member 36 and guide wheels 44,46 may have other shapes than the V-configurations described above. For example, the respective surface shapes may be rounded or square mutually cooperative surfaces. Whatever the respective contours, it is important that the outer surface 40 of the rail member 36 be elevated above the outer surface 24 of the shell member 20.

As noted above, the springs 52,54 connected between the first end of pivotable arms 50,52 provide a bias force that urges the guide wheels 44,46, mounted on the arms 50,52, toward the outer surface 40 of the rail member 36. The bias force provided by the springs 52,54 is sufficient to maintain the guide wheels 44,46 in contact with the rail member 36 during normal operation and yet permits either of the wheels 44,46 to ride over any solid obstruction that it may encounter. This is also true of a possible obstruction that may accidently occur between the support rollers 32,34 and the inner arcuate surface 22 of the shell 20. In this possible occurrence, the shell 20 is able to lift upwardly, raising the biased guide wheel, and passing over an obstruction between the inner surface 22 and one of the fixed support rollers 32,34. Thus, in the event of an obstruction between the shell 20 and either the support rollers 32,34 or the guide wheels 44,46, damage to shell 20 or other components is avoided. Furthermore, the effort required to rotate the cylindrical shell 20, when the cap driver 16 is constructed as described above, is dramatically reduced, resulting in much smoother, uniform movement of the cap holder 18 during the embroidery operation.

Also, it has been discovered that when the cap drivers 16 embodying the present invention have been installed on an embroidery machine 10, the motor driving the actuator rod 30 to rotate the cap drivers 16 remains cool, even after extended hours of operation. Furthermore, it has been noted that the quality of the embroidered design is significantly improved and the quality does not decrease after months of operation.

INDUSTRIAL APPLICABILITY

The cap driver 16 embodying the present invention is particularly useful on multiple head embroidery machines for embroidering decorative designs on caps. The cap driver 16 overcomes the problem of debris buildup in the guide grooves of the prior cap drivers, and thereby avoids the bending and distortion of the cylindrical shell 20 as has heretofore been a common experience.

The spring loaded, pivotable guide wheels 44,46 on the cap driver 16 embodying the present invention provide yieldable, biased support for the cylindrical shell 20 against the support rollers 32,34, as well as urging the guide wheels 44,46 into biased contact with the outer surface 40 of the circular rail member 36.

The above features result in a construction that requires significantly less power to operate, has increased wear life and reduced maintenance requirements.

Most importantly, when installed on an embroidery machine 10, the cap driver 16 embodying the present invention enables the embroidery machine 10 to produce uniform, consistently high quality embroidered designs on caps, even after months or years of operation.

Other aspects, features and advantages of the present invention can be obtained from a study of this disclosure together with the appended claims.

What I claim is:

1. A cap driver for an embroidery machine, said cap driver being rotatably mounted on a moveable frame of said machine and comprising:

a cylindrical shell having arcuate inner and outer surfaces;

a plurality of support rollers rotatably mounted on said moveable frame and in rolling contact with the arcuate inner surface of said cylindrical shell;

a circular rail member circumferentially mounted on said arcuate outer surface of the cylindrical shell and having a predefined outer surface disposed in radially outwardly spaced relationship with respect to the arcuate outer surface of said cylindrical shell; and, a plurality of guide wheels each being rotatably mounted on and pivotably moveable about a predetermined position on said moveable frame and having a circumferentially disposed flanged portion shaped to rotatably engage at least a portion of the predefined outer surface of the circular rail member, the flanged portion of each of said plurality of guide wheels being maintained in yieldable biased contact with said outer surface of the rail member.

2. A cap driver, as set forth in claim 1, wherein said cap driver includes a plurality of moveable arms each pivotably connected at a first end to the movable frame of said embroidery machine and having a spaced second end that is arcuately movable about said pivotable connection, and a respective one of said guide wheels being rotatably mounted on the arcuately movable end of one of said arms.

3. A cap driver, as set forth in claim 2, wherein said cap driver includes a spring member disposed between the arcuately moveable second ends of each of the arms and the movable frame of said embroidery machine.

4. A cap driver, as set forth in claim 1, wherein the predefined outer surface of said circular rail member has an inverted V cross-sectional shape.

5. A cap driver, as set forth in claim 4, wherein the inverted V cross-sectional shape of the predefined outer surface has an included angle of 90°.

6. A cap driver, as set forth in claim 4, wherein the circumferentially disposed ranged portion of each of said plurality of guide wheels is defined by a V-shaped groove adapted to receive the inverted V cross-sectional shape of the rail member therein.

7. A cap driver, as set forth in claim 4, wherein the included angle of the V-shaped groove in each of the guide wheels is 89°.

8. A cap driver, as set forth in claim 1, wherein said arcuate outer surface of the cylindrical shell has a circumferential groove formed therein and said circular rail member has a radially inwardly disposed surface, said inwardly disposed surface being in abutting contact with the groove formed in the outer arcuate surface of said cylindrical shell.

* * * * *